United States Patent [19]

Wendt et al.

[11] Patent Number: 4,497,150

[45] Date of Patent: Feb. 5, 1985

[54] DRIVE-IN TRIM SYSTEM FOR INTERSECTING HOLLOW WALL PARTITIONS

[75] Inventors: Alan C. Wendt, Barrington; David Krakowski, Deerfield, both of Ill.

[73] Assignee: United States Gypsum Company, Chicago, Ill.

[21] Appl. No.: 423,925

[22] Filed: Sep. 27, 1982

[51] Int. Cl.[3] ..... E04F 19/04

[52] U.S. Cl. ..... 52/242; 52/288; 52/718

[58] Field of Search ..... 52/288, 242, 716, 718, 52/717

[56] References Cited

U.S. PATENT DOCUMENTS

| | | | |
|---|---|---|---|
| 2,322,051 | 6/1943 | Nicholson | 52/242 |
| 3,460,302 | 8/1969 | Cooper | 52/242 |
| 3,501,186 | 3/1970 | Wilcox et al. | 52/718 |
| 3,631,642 | 1/1972 | Stewart | 52/288 |
| 3,975,875 | 8/1976 | Goss | 52/211 |
| 4,014,146 | 3/1977 | DiMascio et al. | 52/718 X |
| 4,045,932 | 9/1977 | Bogert | 52/460 |
| 4,304,075 | 12/1981 | Miyoshi | 52/718 X |
| 4,389,069 | 6/1983 | Sengoku | 52/718 |

FOREIGN PATENT DOCUMENTS

| | | | |
|---|---|---|---|
| 225583 | 3/1969 | Sweden | 52/242 |

OTHER PUBLICATIONS

Sweet's Catalog File, 10.1 Uni, "Ultrawall Partition Systems", p. 6, Details 6, 7 alt., United States Gypsum Co., 1977.

*Primary Examiner*—J. Karl Bell

*Attorney, Agent, or Firm*—Robert M. Didrick; Samuel Kurlandsky; Robert H. Robinson

[57] ABSTRACT

A two piece system for driving a piece of trim into place at the intersection of paneled hollow wall partitions comprises a retainer clip and the trim piece. The retainer clip, made of spring steel, has a first leg which is secured to the partition and a detent leg which slips between the edge of said partition and the face of an intersecting partition. A barbed leg of an L-shaped trim piece is driven between said face and the detent leg so that the lip of the barb engages the detent of the retainer clip.

5 Claims, 4 Drawing Figures

DRIVE-IN TRIM SYSTEM FOR INTERSECTING HOLLOW WALL PARTITIONS

This invention relates to readily erected hollow wall partitions which often are used in buildings in which the space is frequently reapportioned to suit changing needs. It particularly relates to the problem of trimming such partitions along the lines of intersection between two such partitions or between a hollow wall partition and a more or less permanent wall of masonry, concrete, plaster, or wood. Such partitions are constructed of specially designed metal studs, runners, struts, rails, and clips and are faced with wall panels, most often gypsum cored panels, Corners formed by the intersection of such partitions usually do not have a finished appearance and means for applying trim pieces quickly and easily are being devised regularly.

A currently popular system for the construction of intersecting partitions of this type comprises the attachment of a runner having a C-shaped cross-section to an in-place wall. The C-shape is defined by a web and two perpendicular flanges. A channel along each edge of the inner face of the web, the outside walls of which channel are formed by the flanges, creates lengthwise detents on the opposite face. A panel attached to a flange of the runner has an edge verging upon the surface of the in-place wall. To give the corner a finished appearance, an elongated leg of an L-shaped piece of aluminum trim is forced between the panel edge and the in-place wall to engage the web detent with a lip at the end of the elongated leg. A wedging action thus forces the new partition away from the wall, creating noticeable gaps where ceiling runners cross the intersection. Removal of the trim piece with its leg caught behind the framing member is often difficult to do without damaging the panel and runner as well as the trim itself.

Thus, there is a very real need for a trim system by which the trim piece may be driven into place yet be easily removed and reused.

It is an object of this invention to provide a new drive-in trim system for paneled hollow wall partition intersections.

It is a related object of this invention to provide a trim system whereby a trim piece may be tapped securely into place at the intersection of paneled partitions yet be removed easily without damage when changing conditions require relocation of the partitions.

It is a further object of this invention to provide a trim system for paneled partitions which does not require the incorporation therein of a specific type of framing member.

The drawings and description of the invention herein show that these and other objects which will be apparent are achieved by this invention.

Turning now to the drawings.

Figure 1:
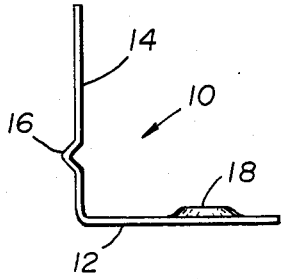
FIG. 1 is an elevational view of a retainer clip of the trim system of this invention.

The retainer clip 10 of FIG. 1 is a strip of flat spring steel bent at a right angle to form a first leg 12 and a second leg 14. A node is stamped into the second leg 14 to form a detent 16 and a hole 18 is provided to accommodate a dry wall screw.

Figure 2:
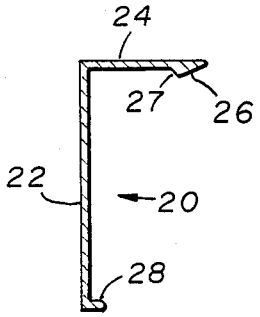
FIG. 2 is a sectional view of a trim piece to be used in combination with the retainer clip.

In FIG. 2, the trim piece 20 is an elongated, L-shaped strip of extruded aluminum having a face plate 22 and a clinch plate 24 having a barbed tip 26, the lip 27 of which is disposed at an acute angle to the plane in which the face plate 22 lies. Alternatively, said lip may be parallel to said plane. A foot 28 serves as a spacer when the trim piece 20 is placed against the surface of a wall panel.

Figure 3:
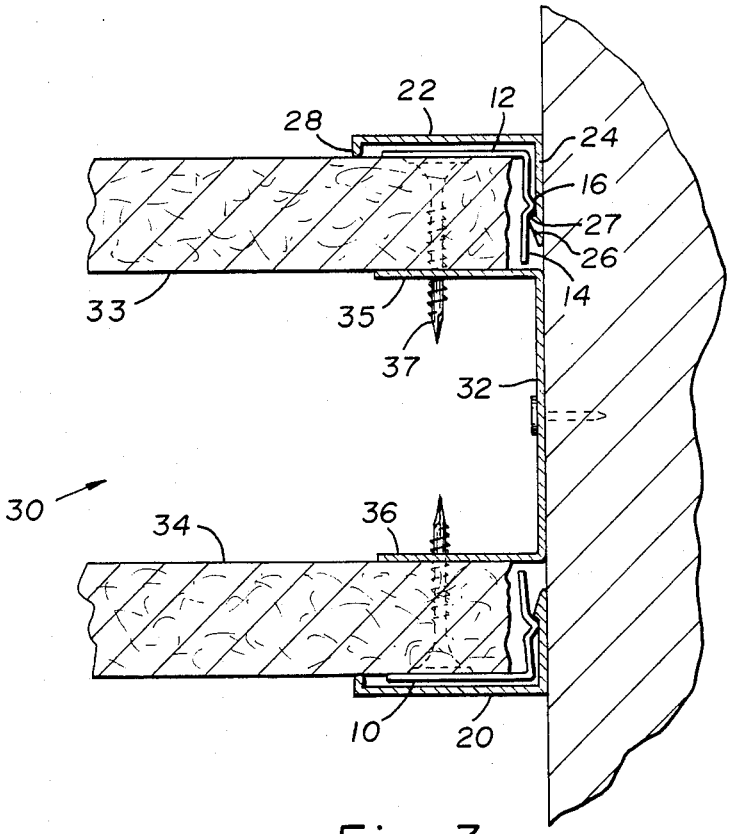
FIG. 3 is a plan view of the trim system in place in a hollow wall partition at its intersection with another wall.

The hollow wall partition 30 of FIG. 3 is constructed by fastening a strut 32 to a permanent wall and attaching the panels 33 and 34 with an adhesive or by other suitable means to the flanges 35 and 36 of the strut. The corner between the panel 33 and the permanent wall is trimmed by inserting a leg 14 of a retainer clip 10 between the edge of the panel and the wall and fastening the clip 10 to the partition with a dry wall screw 37. A trim piece 20 is tapped into place so that the barbed tip 26 pushes the leg 14 away from the wall until the detent 16 engages the lip 27 and the foot 28 touches the panel 33. Panel 34 is trimmed in the same way.

Figure 4:
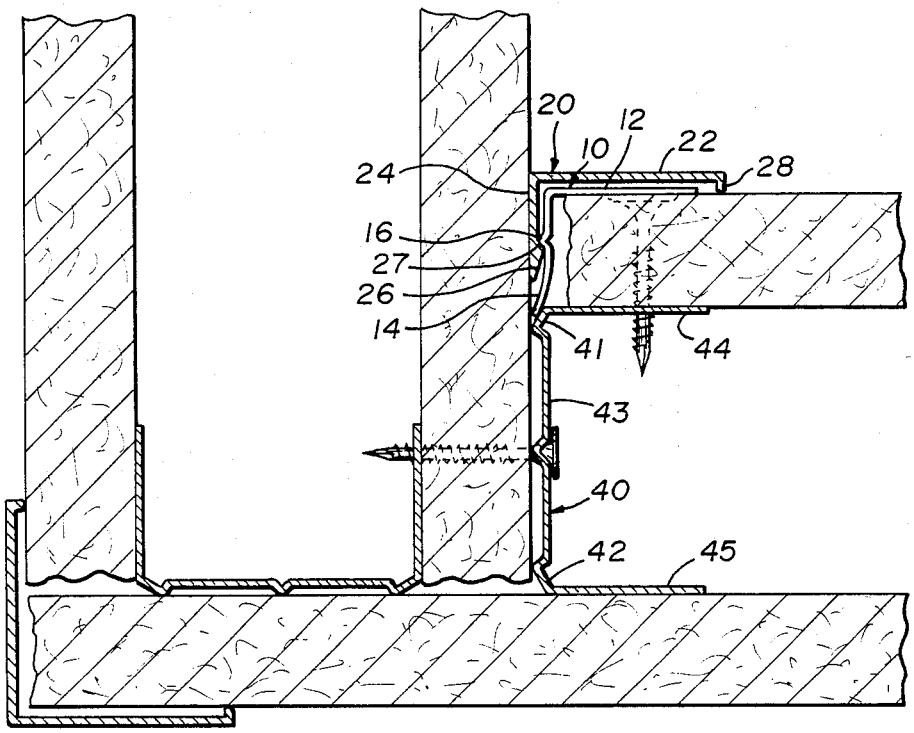
FIG. 4 is a plan view of the trim system in place at the intersection of two hollow wall partitions.

In FIG. 4, the strut 40 has shoulders 41 and 42 connecting the web 43 to the respective flanges 44 and 45. The leg 14 of the retainer clip 10 bears resiliently against the shoulder 41. When braced in such manner, the retainer clip 10 may be made of common mild sheet steel or of thinner spring steel stock than it is when used in the system shown in FIG. 3 wherein the resiliency of the clip alone must anchor the trim piece 20. Thus, when used in the system of FIG. 4, the thickness of the spring steel in the clip 10 may be from about 0.012" to about 0.016", whereas for the clip 10 of the system in FIG. 3, the thickness of the steel may be from about 0.016" to about 0.022".

The retainer clip may be formed from a strip of indefinite length, cut to length and then heat treated. It is more economical and therefore preferable to space individual clips, the legs of which are each about 1" square, along the intersection at about 24" o.c. intervals.

Although flat spring steel is the preferred stock for the retainer clip, a heavy gauge music wire of at least 0.050" diameter is also contemplated. The bent wire retainer clip would be attached to the partition by a dry wall screw passing through a bight formed at one end of the first leg of the clip.

The use of the retainer clip of this invention permits the use of a trim piece having a clinch plate which is from about 0.5" to about 0.75" wide whereas the clinch plate in the old system described above is about 1.25" wide. This not only reduces the cost of the elongated trim pieces but also adds to the ease of removal of the trim piece when desired.

The trim may also be made of a plastic or of another structural metal such as steel instead of aluminum. Various embodiments of the invention thus illustrated and described may be suggested hereby to one skilled in the art but still be within the spirit and scope of the appended claims.

What we claim is:

1. A trim system for the intersections of paneled partitions which comprises:

an L-shaped retainer clip comprising a first leg, a second leg substantially perpendicular to and continuous with the first leg, the second leg having a detent formed therein, the first leg being secured to a first partition and the second leg extending between the edge of the panel in the first partition and the face of the intersecting partition, and an L-shaped trim piece comprising a face plate and a clinch plate, the clinch plate having a lip on its inner surface distal to the face plate;

the clinch plate being driven between the face of the intersecting partition and the second leg of said retainer clip, the lip of said clinch plate and the detent of the second leg being in frictional engagement.

2. A trim system for the intersections of paneled partitions which comprises:

a framing member having a web, a pair of co-directional flanges at right angles to the plane in which the web lies and spaced apart at the opposite margins of the web, and a shoulder connecting each flange to its respective margin of the web, an L-shaped retainer clip comprising a first leg, a second leg substantially perpendicular to and continuous with the first leg, the second leg having a detent formed therein, the first leg being secured to a first partition and the second leg being inserted between the edge of the panel in the first partition and the face of the intersecting partition, the second leg resiliently bearing upon the framing member shoulder adjacent to the panel in the first partition, and an L-shaped trim piece comprising a face plate and a clinch plate, the clinch plate having a lip on its inner surface disposed at an acute angle to the face plate and distal thereto, the clinch plate being driven between the face of the intersecting partition and the second leg of the retainer clip, the lip of the clinch plate and the detent of the second leg being in frictional engagement.

3. The trim system of claim 2 wherein the framing member shoulder is at an obtuse angle to the flange.

4. The trim system of claim 1 or claim 2 wherein the detent in the second leg is a V-shaped node whose apex is pointed toward the face of the intersecting partition.

5. The trim system of claim 1 wherein the first partition has an obverse face and a reverse face and the first leg of the retainer clip abuts the obverse face of the first partition.

* * * * *